US010515503B2

(12) United States Patent
Hamada et al.

(10) Patent No.: US 10,515,503 B2
(45) Date of Patent: Dec. 24, 2019

(54) SHEET PROCESSING SYSTEM, SHEET PROCESSING APPARATUS, AND SHEET HOUSING SECTION

(71) Applicant: GLORY LTD., Hyogo (JP)

(72) Inventors: Takuro Hamada, Hyogo (JP); Takeshi Yokawa, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/921,695

(22) Filed: Mar. 15, 2018

(65) Prior Publication Data

US 2018/0268638 A1 Sep. 20, 2018

(30) Foreign Application Priority Data

Mar. 15, 2017 (JP) ..... 2017-049791

(51) Int. Cl.

| | |
|---|---|
| ***G07D 11/18*** | (2019.01) |
| ***G07D 11/13*** | (2019.01) |
| ***G07D 11/14*** | (2019.01) |
| ***G07D 11/22*** | (2019.01) |
| ***G07D 11/125*** | (2019.01) |
| ***B65H 31/24*** | (2006.01) |

(Continued)

(52) U.S. Cl.

CPC ..... *G07D 11/18* (2019.01); *B65H 31/24* (2013.01); *G07D 11/10* (2019.01); *G07D 11/125* (2019.01); *G07D 11/13* (2019.01); *G07D 11/14* (2019.01); *G07D 11/16* (2019.01); *G07D 11/22* (2019.01); *B65H 2301/3121* (2013.01); *B65H 2301/34112* (2013.01); *B65H 2402/10* (2013.01); *B65H 2701/1912* (2013.01); *G07D 7/00* (2013.01); *G07D 2207/00* (2013.01); *G07D 2211/00* (2013.01)

(58) Field of Classification Search

CPC ..... B65H 29/006; B65H 29/008; B65H 2701/1912; G07D 11/0021

See application file for complete search history.

(56) References Cited

U.S. PATENT DOCUMENTS

| | | | | |
|---|---|---|---|---|
| 6,439,395 | B1 | 8/2002 | Voellmer et al. | |
| 2011/0130870 | A1* | 6/2011 | Aoji | G07D 11/0081 700/218 |

FOREIGN PATENT DOCUMENTS

| | | |
|---|---|---|
| DE | 19810928 A1 | 9/1999 |
| EP | 1393823 A2 | 3/2004 |

(Continued)

OTHER PUBLICATIONS

Extended European Search Report for EP18161451.2 dated Jul. 13, 2018.

*Primary Examiner* — Jeremy R Severson

(74) *Attorney, Agent, or Firm* — Brundidge & Stanger, P.C.

(57) ABSTRACT

A sheet processing system A includes a sheet processing apparatus 1 that transports and stores a sheet in one of short-edge leading orientation and long-edge leading orientation; a sheet housing section 3 that stores the sheet in the other of the short-edge leading orientation and the long-edge leading orientation; and an orientation changing section 4 that transports the sheet between the sheet processing apparatus 1 and the sheet housing section 3, changes transport orientation of the sheets which is being transported between the short-edge leading orientation and the long-edge leading orientation.

7 Claims, 10 Drawing Sheets

(51) Int. Cl.

| | |
|---|---|
| ***G07D 11/16*** | (2019.01) |
| ***G07D 11/10*** | (2019.01) |
| *G07D 7/00* | (2016.01) |

(56) References Cited

FOREIGN PATENT DOCUMENTS

| | | | | |
|---|---|---|---|---|
| JP | 2001-266215 | A | 9/2001 | |
| JP | 2003-346210 | A | 12/2003 | |
| JP | 2008-090616 | A | 4/2008 | |
| JP | 4732966 | B2 | 7/2011 | |
| WO | 2013/050177 | A1 | 4/2013 | |
| WO | WO-2013050177 | A1 * | 4/2013 | ..... G07D 11/0003 |

* cited by examiner

SHEET PROCESSING SYSTEM, SHEET PROCESSING APPARATUS, AND SHEET HOUSING SECTION

CROSS REFERENCE TO RELATED APPLICATIONS

This application is entitled to and claims the benefit of Japanese Patent Application No. 2017-049791, filed on Mar. 15, 2017, the disclosure of which including the specification, drawings and abstract is incorporated herein by reference in its entirety.

TECHNICAL FIELD

The present invention relates to a sheet processing system adapted to handle a sheet in long-edge leading orientation and short-edge leading orientation, a sheet processing apparatus used in the sheet processing system, and a sheet housing section used in the sheet processing system.

BACKGROUND ART

Conventionally, various sheet processing apparatuses are used, including automated teller machines, banknote depositing and dispensing machines, vending machines, ticket-vending machines, and change-giving machines.

Of these sheet processing apparatuses, with automated teller machines, banknote depositing and dispensing machines, and other apparatuses that handle large quantities of banknotes at a time, particular importance is placed on banknote processing speed. These apparatuses handle banknotes in short-edge leading orientation. That is, the banknotes are transported in short-edge leading orientation and taken out of and housed in the housing section in short-edge leading orientation. Note that the short-edge leading orientation is an orientation in which short sides of a rectangular sheet such as a banknote are aligned with a forward/backward direction of travel. In other words, the short-edge leading orientation is an orientation in which the sheet travels with a long side of the sheet at the head.

As an example of sheet processing apparatuses that handle banknotes in short-edge leading orientation, PTL 1 discloses an automatic cash transaction apparatus used in banking services.

On the other hand, on vending machines, ticket-vending machines, change-giving machines, and other machines for which importance is placed on reduction of installation space, banknotes are handled in long-edge leading orientation. That is, the banknotes are transported in long-edge leading orientation and taken out of and housed in the housing section in long-edge leading orientation. Note that the long-edge leading orientation is an orientation in which long sides of a rectangular sheet such as a banknote are aligned with a forward/backward direction of travel. In other words, the long-edge leading orientation is an orientation in which the sheet travels with a short side of the sheet at the head.

As an example of sheet processing apparatuses that handle banknotes in long-edge leading orientation, PTL 2 discloses a banknote processing apparatus mounted inside a vending machine, money-changing machine, amusement machine, or the like.

CITATION LIST

Patent Literature

PTL 1
Japanese Patent Application Laid-Open No. 2008-090616
PTL 2
Japanese Patent Application Laid-Open No. 2003-346210

SUMMARY OF INVENTION

Technical Problem

Convenience stores, stations, leisure facilities, and other facilities in which plural types of sheet processing apparatuses are installed, a sheet processing apparatus that handles banknotes in short-edge leading orientation and a sheet processing apparatus that handles banknotes in long-edge leading orientation may be installed together. In such facilities, it is not possible to efficiently transfer banknotes between the sheet processing apparatus that handles banknotes in short-edge leading orientation and the sheet processing apparatus that handles banknotes in long-edge leading orientation.

In view of the above circumstances, an object of the present invention is to allow banknotes to be transferred efficiently between a sheet processing apparatus that handles banknotes in short-edge leading orientation and a sheet processing apparatus that handles banknotes in long-edge leading orientation.

Solution to Problem

A sheet processing system according to the present invention includes: a sheet processing apparatus that transports and stores a sheet in one of short-edge leading orientation and long-edge leading orientation; a sheet housing section that stores the sheet in the other of the short-edge leading orientation and the long-edge leading orientation; and an orientation changing section that transports the sheet between the sheet processing apparatus and the sheet housing section and changes transport orientation of the sheet which is being transported between the short-edge leading orientation and the long-edge leading orientation.

A sheet processing apparatus according to the present invention is used in a sheet processing system that includes: the sheet processing apparatus that transports and stores a sheet in one of short-edge leading orientation and long-edge leading orientation; a sheet housing section that stores the sheet in the other of the short-edge leading orientation and the long-edge leading orientation; and an orientation changing section that transports the sheet between the sheet processing apparatus and the sheet housing section and changes transport orientation of the sheet which is being transported between the short-edge leading orientation and the long-edge leading orientation.

A sheet housing section according to the present invention is used in a sheet processing system that includes: a sheet processing apparatus that transports and stores a sheet in one of short-edge leading orientation and long-edge leading orientation; the sheet housing section that stores the sheet in the other of the short-edge leading orientation and the long-edge leading orientation; and an orientation changing section that transports the sheet between the sheet processing apparatus and the sheet housing section and changes transport orientation of the sheet between the short-edge leading orientation and the long-edge leading orientation.

Advantageous Effects of Invention

The present invention can efficiently transfer banknotes between the sheet processing apparatus that handles banknotes in short-edge leading orientation and sheet processing apparatus that handles banknotes in long-edge leading orientation.

DESCRIPTION OF EMBODIMENTS

The present invention will be described in detail below with reference to the accompanying drawings. Note that in the following description, the "front" of a sheet processing apparatus means the side of an operator who performs at least one of sheet input and output operations through an opening section, and the "rear" of the sheet processing apparatus means the side opposite the front side. Also, the "left" of the sheet processing apparatus means the left side as viewed from the operator and the "right" of the sheet processing apparatus means the right side as viewed from the operator.

Also, a "normal banknote" is a genuine banknote identified successfully by an identification section described later and a "rejected banknote" is a banknote that cannot be processed by a predetermined process. For example, a banknote unidentifiable by the identification section in a replenishment process a banknote identified by the identification section but inappropriate in terms of denomination, a banknote identified by the identification section but unable to be taken into the apparatus due to a transport failure, or other similar banknote is referred to as a "rejected replenishment banknote." A "fit note" refers to a banknote relatively free of stain, tear, and the like among normal banknotes, and an "unfit note" refers to a banknote stained or torn relatively heavily among normal banknotes.

Figure 1:
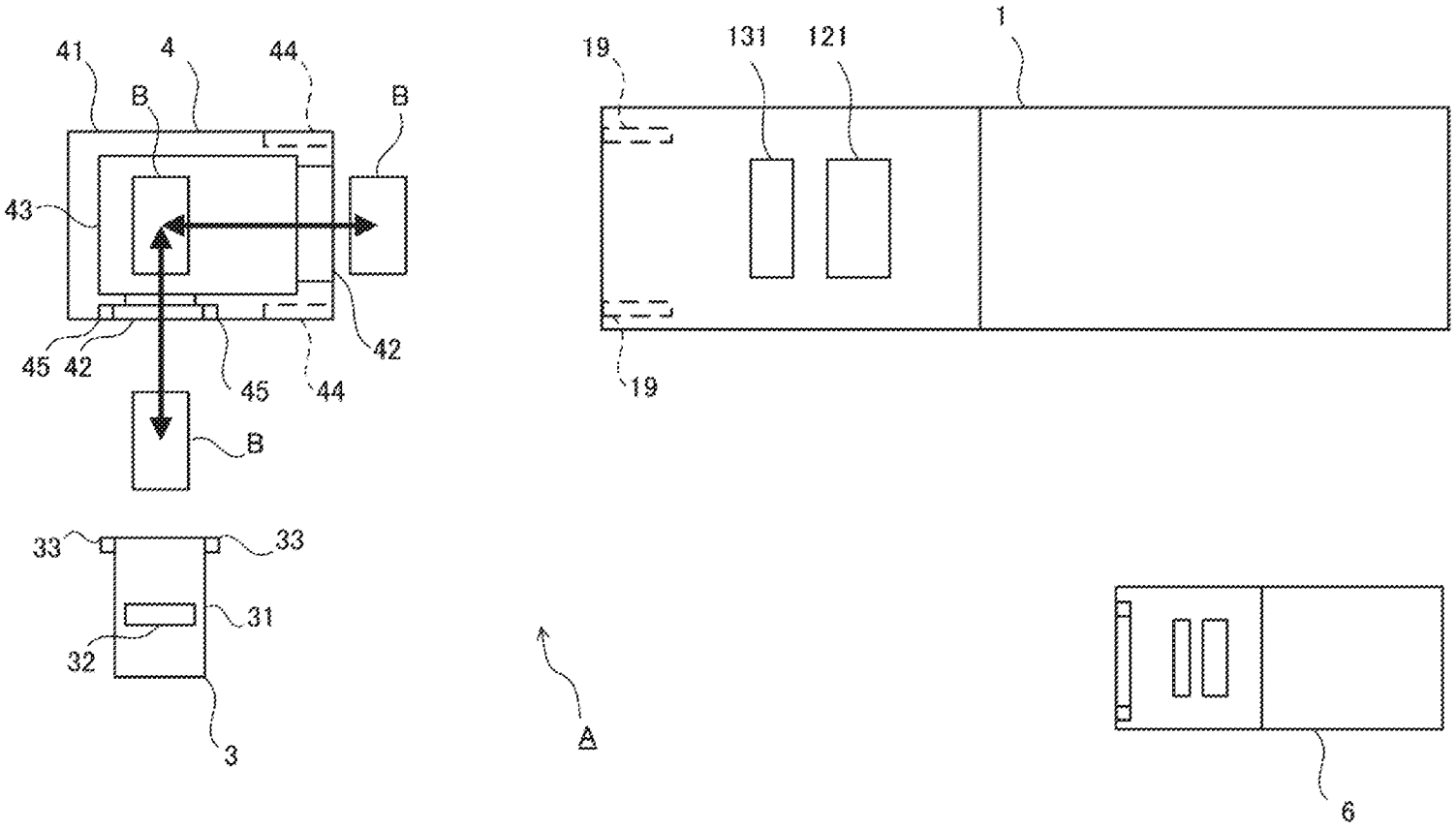
FIG. 1 is a schematic diagram of a sheet processing system according to Embodiment 1 of the present invention.

A schematic diagram of a sheet processing system according to the present invention in planar view is shown in FIG. 1. In FIG. 1, reference character A denotes the sheet processing system, reference numeral 1 denotes a banknote processing apparatus, which is an example of the sheet processing apparatus, reference numeral 3 denotes a sheet housing section, which is an example of a sheet housing section, and reference numeral 4 denotes an orientation changing section. The banknote housing section 3 is configured to be detachable with respect to a second banknote processing apparatus 6.

Figure 2:
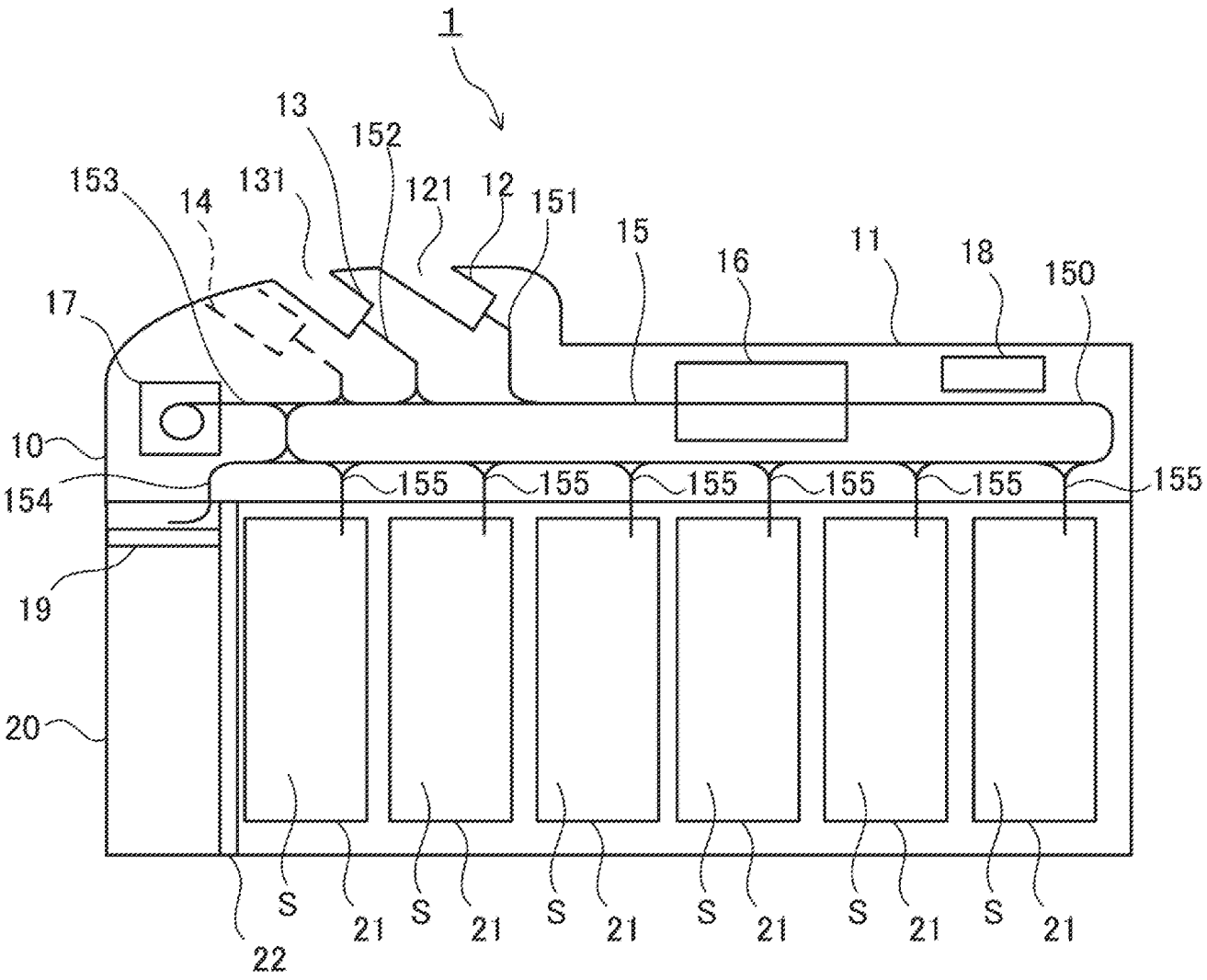
FIG. 2 is a schematic right side view of a banknote processing system used in the sheet processing system according to Embodiment 1 of the present invention.

The banknote processing apparatus 1 is a banknote depositing and dispensing machine adapted to deposit and dispense banknotes. A schematic diagram of the banknote processing apparatus 1 in right side view is shown in FIG. 2. The banknote processing apparatus 1 includes a processing section 10 and a storage 20 configured to be lockable and provided below the processing section 10. The left side of FIG. 2 corresponds to the front side of the banknote processing apparatus 1 and the right side of FIG. 2 corresponds to the rear side of the banknote processing apparatus 1.

The processing section 10 has an upper casing 11. A deposit port (opening) 121 and a dispense port (opening) 131 are provided in upper front part of the upper casing 11. A transport section 15, an identification section 16, a temporary holding section 17, and a control section 18 are placed in the upper casing 11.

A banknote feed mechanism (not shown) adapted to feed banknotes one by one in short-edge leading orientation at a predetermined frequency is placed near the deposit port 121. The deposit port 121 and banknote feed mechanism make up a deposit section 12.

A stacking mechanism (not shown) adapted to stack banknotes is placed near the dispense port 131. The dispense port 131 and stacking mechanism make up a dispense section 13. A second dispense section 14 having a configuration similar to that of the dispense section 13 may be provided next to the dispense section 13 as needed.

Note that only one of the deposit section 12 and dispense section 13 may be provided as needed in upper front part of the processing section 10. Also, an opening section used to both deposit and dispense banknotes may be provided in the upper front part of the processing section 10 and a deposit and dispense section may be provided by placing the banknote feed mechanism and stacking mechanism around the opening section.

The transport section 15 transports banknotes in short-edge leading orientation at a predetermined transport speed. The transport section 15 is made up of a belt mechanism and roller mechanism adapted to transport banknotes. The transport section 15 includes a looped transport path 150 that allows banknotes to be transported bidirectionally as well as a first branch path 151, a second branch path 152, a third branch path 153, a fourth branch path 154, and fifth branch paths 155 branching off from the looped transport path 150. The first branch path 151 to the fifth branch paths 155 connects the looped transport path 150, respectively, with the deposit section 12, the dispense section 13, the temporary holding section 17, the orientation changing section 4, and a storage unit 21 described later. Note that the banknote processing apparatus 1 shown in FIG. 1 has six fifth branch paths 155.

The identification section 16 includes sensors such as an image sensor, optical sensor, and magnetic sensor and identifies the authenticity, denomination, fitness/unfitness, and the like of each banknote transported by the transport section 15.

The temporary holding section 17 temporarily stores banknotes. The temporary holding section 17 takes in banknote one by one in short-edge leading orientation, stores the banknotes, and feeds the stored banknotes one by one in short-edge leading orientation. The temporary holding section 17 can be made up, for example, of a take-up storage section in which plural sheets are stored by being wound around a rotating body.

The control section 18 includes at least a CPU and memory. The control section 18 controls various components of the banknote processing apparatus 1 via the transport section 15 such that banknotes will be transported through the deposit section 12, dispense section 13, temporary holding section 17, storage unit 21, and banknote housing section 3. Also, the control section 18 controls operations of the orientation changing section 4 and banknote housing section 3.

The storage 20 has a lockable storage door 22. The storage 20 can be made up, for example, of a safe. Six storage units 21 are placed in the storage 20.

One storage area S is provided in each storage unit 21. The storage area S is, for example, a stacking storage in which plural sheets are stored in a stacked state. Banknotes go in and out of the storage area S in short-edge leading orientation.

The foremost fifth branch path 155 is connected to the storage area S in the first storage unit 21 from the front. The subsequent five fifth branch paths 155 are similarly connected, respectively, to the storage areas S in the second to the sixth storage units 21 from the front.

Being configured as described above, the banknote processing apparatus 1 has six storage areas S in total. Thus, by being identified by the identification section 16, banknotes can be classified into six kinds according to authenticity, fitness/unfitness, denomination, or the like, and by switching a destination by controlling the transport section 15, the banknotes can be stored by assigning the storage areas S according to the kinds. Of course, if the dispense section 13 and temporary holding section 17 are used, the destination can be switched by classifying the banknotes into a still larger number of kinds.

The banknote processing apparatus 1 has a connector 19 for use to attach and detach the orientation changing section 4. According to the present embodiment, the connector 19 is provided on a front side of the storage 20 below the processing section 10.

Returning to FIG. 1, the banknote housing section 3 will be described. The banknote housing section 3 is a detachable component of the second banknote processing apparatus 6. The banknote housing section 3 has a housing section casing 31. The banknote housing section 3 has a take-up storage mechanism 32 inside the housing section casing 31. The take-up storage mechanism 32 stores plural sheets by winding the sheets around a rotating body in long-edge leading orientation. A mounting portion 33 is provided on an outer surface of the housing section casing 31 to detachably attach the banknote housing section 3 to the orientation changing section 4 or second banknote processing apparatus 6. According to the present embodiment, operation of the take-up storage mechanism 32 is controlled by the control section 18. Note that the banknote housing section 3 may have a control section separately to control the operation of the take-up storage mechanism 32. The control section of the banknote housing section 3 may operate in cooperation with the control section 18 of the banknote processing apparatus 1 or a control section of the orientation changing section 4 described later.

Note that the second banknote processing apparatus 6 is, for example, a change-giving machine. In the second banknote processing apparatus 6, banknotes are transported and housed in long-edge leading orientation. The second banknote processing apparatus 6 may have the banknote housing section 3 detachably stored inside a casing or detachably attached to an outer side of the casing. Both in the second banknote processing apparatus 6 and banknote housing section 3, banknotes are transported and housed in long-edge leading orientation, eliminating the need to provide the orientation changing section 4 between the second banknote processing apparatus 6 and banknote housing section 3. Banknotes are transferred between the banknote processing apparatus 1 and second banknote processing apparatus 6 via the banknote housing section 3. The process of transferring the banknotes from the banknote processing apparatus 1 to the second banknote processing apparatus 6 is referred to as a recovery process when viewed from the banknote processing apparatus 1, and as a replenishment process when viewed from the second banknote processing apparatus 6. Conversely, the process of transferring the banknotes from the second banknote processing apparatus 6 to the banknote processing apparatus 1 is referred to as a replenishment process when viewed from the banknote processing apparatus 1, and as a recovery process when viewed from the second banknote processing apparatus 6. In the recovery process and replenishment process, since banknotes can be transferred between the two processing apparatuses via the banknote housing section 3, the banknotes are not touched by human hands. This improves security as well as improves the efficiency of transferring the banknotes.

The orientation changing section 4 will be described by continuing to refer to FIG. 1. The orientation changing section 4 includes a changing section casing 41, two delivery sections 42 adapted to deliver banknotes to/from the banknote processing apparatus 1 or banknote housing section 3, and an orientation changing mechanism 43 placed between the two delivery sections 42. The banknote received by a first of the delivery sections 42 has its transport orientation changed between short-edge leading orientation and long-edge leading orientation by the orientation changing mechanism 43, and is sent out from a second of the delivery section 42. According to the present embodiment, operation of the orientation changing mechanism 43 is controlled by the control section 18. Note that the orientation changing section 4 may have a control section separately to control the operation of the orientation changing mechanism 43. The control section of the orientation changing section 4 may operate in cooperation with the control section 18 of the banknote processing apparatus 1 or operate independently without regard to the control section 18 of the banknote processing apparatus 1. Also, the control section of the orientation changing section 4 may control the operation of the take-up storage mechanism 32.

The changing section casing 41 is provided with a male connector 44 adapted to cooperate with the connector 19 in attaching and detaching the orientation changing section 4 to/from the banknote processing apparatus 1. Furthermore, the changing section casing 41 is provided with a mount 45 adapted to cooperate with the mounting portion 33 in attaching and detaching the banknote housing section 3 to/from the orientation changing section 4. The connector 19 and male connector 44 as well as the mount 45 and mounting portion 33 can be selected from known mechanisms used to detachably attach two members to each other. Also, there may be cases in which the banknote housing section 3 does not have a drive mechanism such as a motor to drive the take-up storage mechanism 32. In such a case, the orientation changing section 4 may include a drive mechanism to transmit a driving force to the take-up storage mechanism 32 of the attached banknote housing section 3.

In the orientation changing section 4 according to the present embodiment, the two delivery sections 42 and the orientation changing mechanism 43 are placed such that a direction of connection between the first delivery section 42 and orientation changing mechanism 43 and a direction of connection between the second delivery section 42 and orientation changing mechanism 43 will intersect each other at an angle of 90 degrees. As indicated by arrows in FIG. 1, a banknote B received in one of short-edge leading orientation and long-edge leading orientation is not rotated itself, and is caused to make a 90-degree turn in transport direction by the orientation changing mechanism 43. As a result, the banknote B is sent out from the orientation changing section 4 in the other of the transport orientations: short-edge leading orientation or long-edge leading orientation. Such an orientation changing mechanism is a publicly known technique as disclosed, for example, in Japanese Patent No. 4732966, and thus detailed description thereof will be omitted herein.

Figure 3:
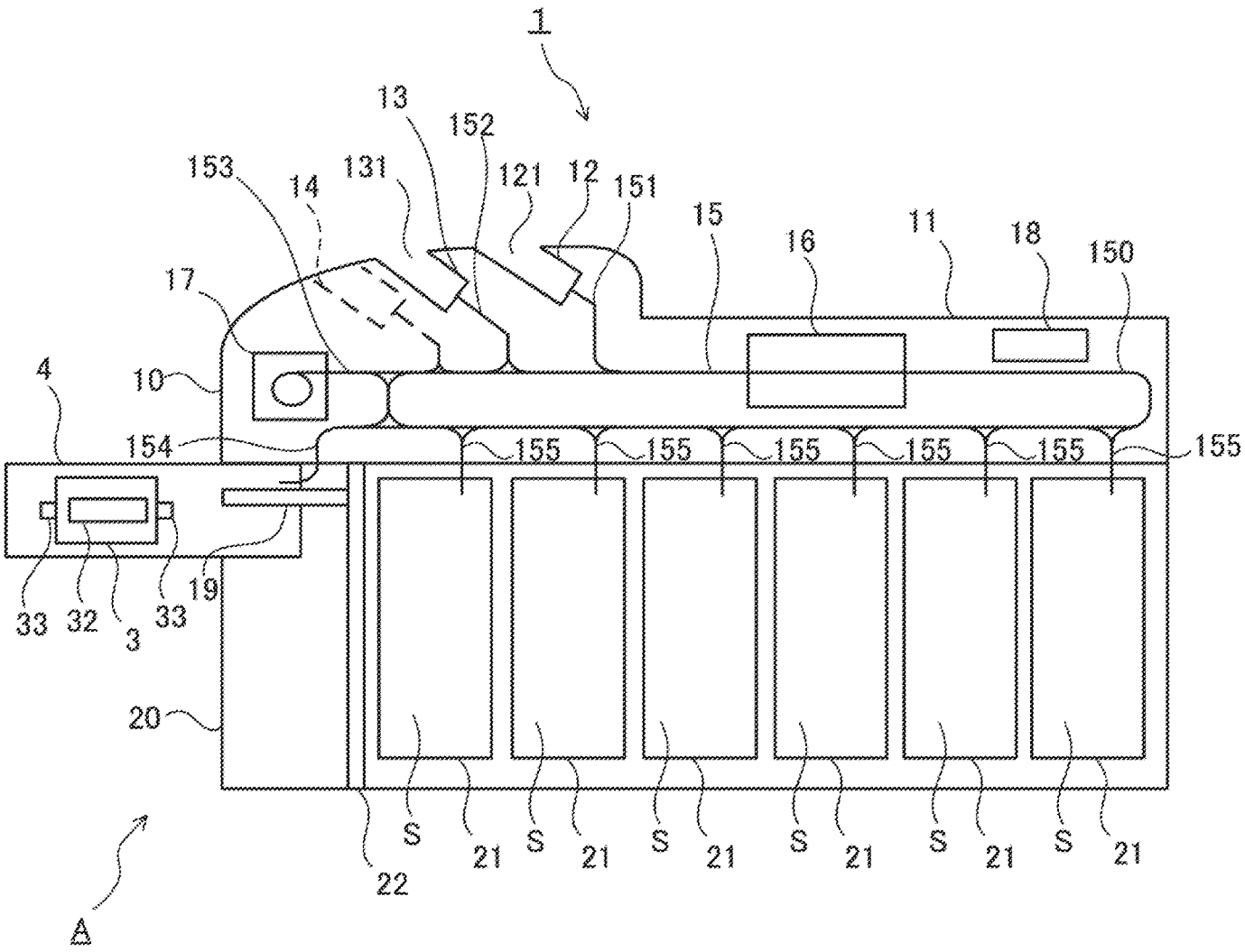
FIG. 3 is a schematic diagram showing a state of the sheet processing system according to Embodiment 1 of the present invention during operation.

FIG. 3 shows how the orientation changing section 4 is attached to the banknote processing apparatus 1 and how the banknote housing section 3 is attached to the orientation changing section 4. An example of operation of the sheet processing system A according to the present embodiment will be described with reference to FIGS. 1 and 3.

First, the replenishment process that replenishes the banknote processing apparatus 1 with banknotes using the banknote housing section 3 will be described. Upon receiving a banknote output command from the control section 18, the banknote housing section 3 supplies banknotes B one by one in long-edge leading orientation to the orientation changing section 4 from the take-up storage mechanism 32.

The orientation changing section 4 receives the banknotes B supplied in long-edge leading orientation on the first delivery section 42 and changes the transport orientation to the short-edge leading orientation using the orientation changing mechanism 43. Next, the orientation changing section 4 supplies the banknotes B in short-edge leading orientation to the fourth branch path 154 via the second delivery section 42.

The banknotes B supplied in short-edge leading orientation to the fourth branch path 154 are transported in short-edge leading orientation on the looped transport path 150 and identified by the identification section 16. The banknotes B identified by the identification section 16 are transported in short-edge leading orientation to any of the six storage units 21 according to the identification results and stored in short-edge leading orientation.

Note that if banknotes are transported within the looped transport path 150 clockwise when the banknote processing apparatus 1 is viewed from the right (in FIG. 3), since the banknotes identified by the identification section 16 can be stored directly in the six storage units 21 by being classified according to the kinds, a large quantity of banknotes B can be processed in a short time.

On the other hand, the banknotes B can also be transported within the looped transport path 150 counterclockwise when the banknote processing apparatus 1 is viewed from the right. In this case, of the banknotes B identified by the identification section 16, rejected banknotes may be transported to the dispense section 13 while temporarily holding the other banknotes in the temporary holding section 17. Note that the banknotes held in the temporary holding section 17 are stored in the six storage units 21 by being classified according to the kinds after all the banknotes housed in the banknote housing section 3 are transported to the temporary holding section 17 or dispense section 13.

According to the present embodiment, the connector 19 for use to attach the orientation changing section 4 is provided on a front side of the banknote processing apparatus 1. This provides the advantage that the operator who operates the banknote processing apparatus 1 from the front side can easily attach the orientation changing section 4 to the banknote processing apparatus 1.

Furthermore, according to the present embodiment, since the connector 19 is provided below the processing section 10, equipment layout in the processing section 10 is not affected. Consequently, the temporary holding section 17 can be provided, for example, on a front side within the processing section 10. This provides the advantage that various banknote processing can be performed using the temporary holding section 17. Note that when there is no need to provide the temporary holding section 17, of course, the connector 19 may be provided on the front side of the processing section 10 and the looped transport path 150 and orientation changing section 4 may be connected via the linear fourth branch path 154.

Next, the recovery process that recovers banknotes from the banknote processing apparatus 1 using the banknote housing section 3 will be described. Upon receiving a banknote receipt command from the control section 18, the banknote housing section 3 enters a standby state to store the banknotes B supplied from the orientation changing section 4 in the take-up storage mechanism 32.

The banknotes B to be subjected to the recovery process are fed from any of the six storage units 21. The banknotes B fed in short-edge leading orientation from the storage units 21 are supplied to the looped transport path 150 through the fifth branch paths 155. The banknotes B are transported within the looped transport path 150 counterclockwise when the banknote processing apparatus 1 is viewed from the right (in FIG. 3) and are identified by the identification section 16. The banknotes B identified by the identification section 16 are verified to be in the denomination targeted for the recovery process and supplied in short-edge leading orientation to the orientation changing section 4 through the fourth branch path 154.

The orientation changing section 4 receives the banknotes B supplied in short-edge leading orientation on the second delivery section 42 and the orientation changing mechanism 43 changes the transport orientation to the long-edge leading orientation. Next, the orientation changing section 4 supplies the banknotes B in long-edge leading orientation to the banknote housing section 3 via the first delivery section 42.

The banknote housing section 3 stores the banknotes B supplied from the orientation changing section 4 in the take-up storage mechanism 32.

Figure 4:
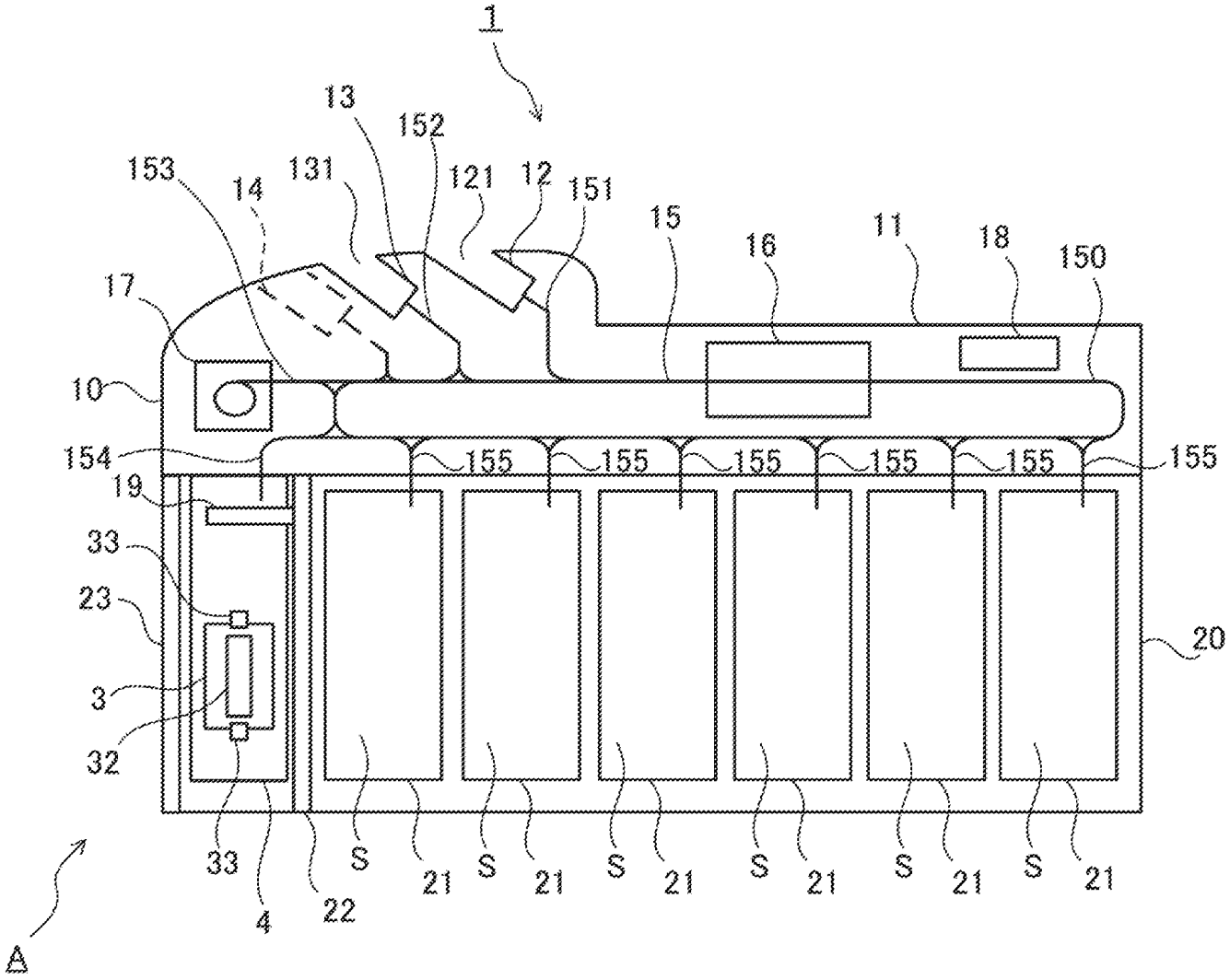
FIG. 4 is a schematic diagram showing a sheet processing system according to Embodiment 2 of the present invention.

A sheet processing system according to Embodiment 2 of the present invention is shown in FIG. 4. The present embodiment differs from Embodiment 1 in that in front of the lockable storage door 22, the storage 20 has a cover 23 that widely covers a space in front of the storage door 22. Also, the present embodiment differs in that the orientation changing section 4 is attached to the banknote processing apparatus 1 in an upright posture.

According to the present embodiment, the orientation changing section 4 attached to the connector 19 and the banknote housing section 3 attached to the orientation changing section 4 can be covered with the cover 23. This makes it possible to keep the banknote housing section 3 and orientation changing section 4 out of view while banknotes are being transferred between the banknote housing section 3 and banknote processing apparatus 1 and allow the banknote transfer operation to be performed more safely and efficiently.

Figure 5:
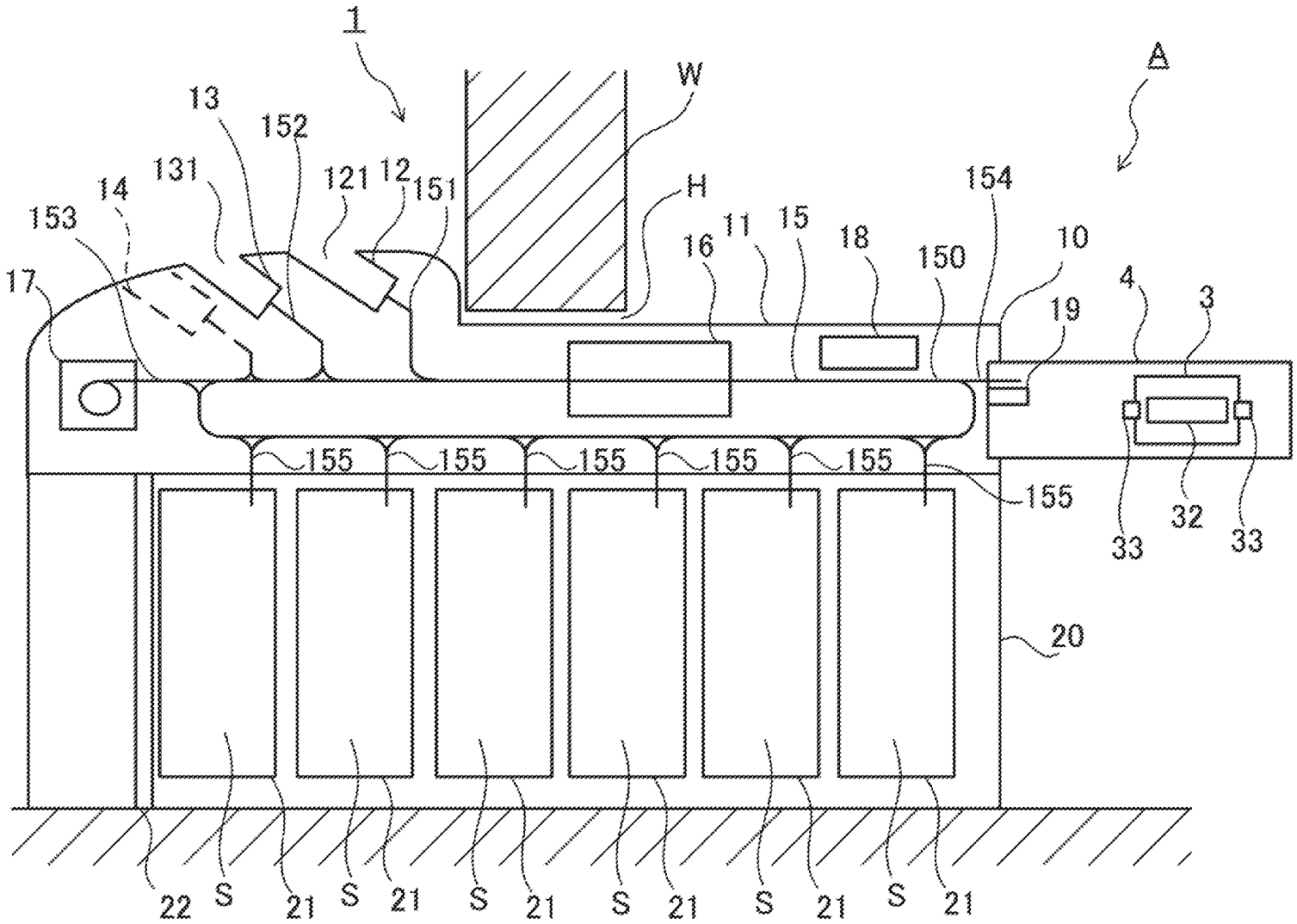
FIG. 5 is a schematic diagram showing a sheet processing system according to Embodiment 3 of the present invention.

A sheet processing system according to Embodiment 3 of the present invention is show in FIG. 5. According to the present embodiment, the connector 19 is provided on a back side of the processing section 10. Also, the banknote processing apparatus 1 is installed by being inserted halfway into a through-hole H provided in a wall W.

According to the present embodiment, those who operate the banknote processing apparatus 1 from the front side, such as a person located on the front side of the banknote processing apparatus 1, cannot access the back side of the banknote processing apparatus 1 due to the existence of the wall W. Thus, the present embodiment has the advantage that personnel of facilities and workers of guarded transport services and the like can safely perform the operation of replenishing the banknote processing apparatus 1 with banknotes or recovering banknotes from the banknote processing apparatus 1 using the banknote housing section 3 and orientation changing section 4.

Note that due to the existence of the wall W, the worker cannot move quickly from the back side to the front side of the banknote processing apparatus 1. Thus, if banknotes are replenished into the banknote processing apparatus 1 from the banknote housing section 3 placed on the back side of the banknote processing apparatus 1, any rejected banknotes are transported to the temporary holding section 17 and stored therein rather than to the dispense section 13. This makes it possible to manage rejected banknotes safely. Note that the rejected banknotes stored in the temporary holding section 17 may be either kept stored in the temporary holding section 17 or returned to the banknote housing section 3 after the banknote housing section 3 becomes empty.

Figure 6:
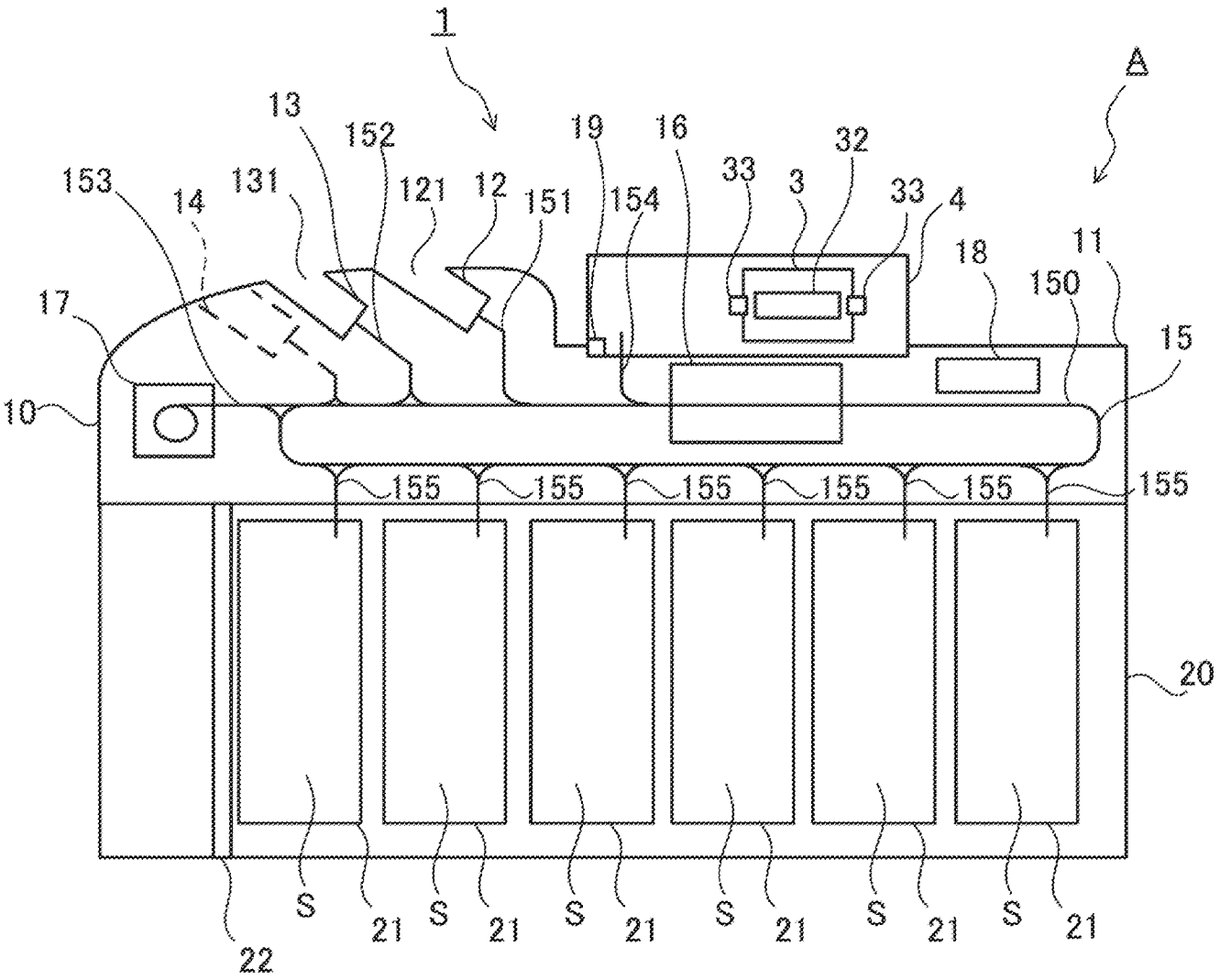
FIG. 6 is a schematic diagram showing a sheet processing system according to Embodiment 4 of the present invention.

A sheet processing system according to Embodiment 4 of the present invention is show in FIG. 6. According to the present embodiment, the connector 19 is provided on a top side of the processing section 10. That is, the orientation changing section 4 is attached to a top face of the processing section 10.

According to the present embodiment, the fourth branch path 154 connected to the orientation changing section 4 is connected to the looped transport path 150 at a position between the deposit section 12 and identification section 16. Also, in the looped transport path 150, banknotes are transported clockwise when the banknote processing apparatus 1 is viewed from the right (in FIG. 6). Thus, after the banknotes supplied into the looped transport path 150 from the banknote housing section 3 is identified by the identification section 16, the banknotes can be transported directly to any of the six storage units 21, the temporary holding section 17, and the dispense section 13 according to identification results. Therefore, a large quantity of banknotes can be processed in a short time.

Figure 7:
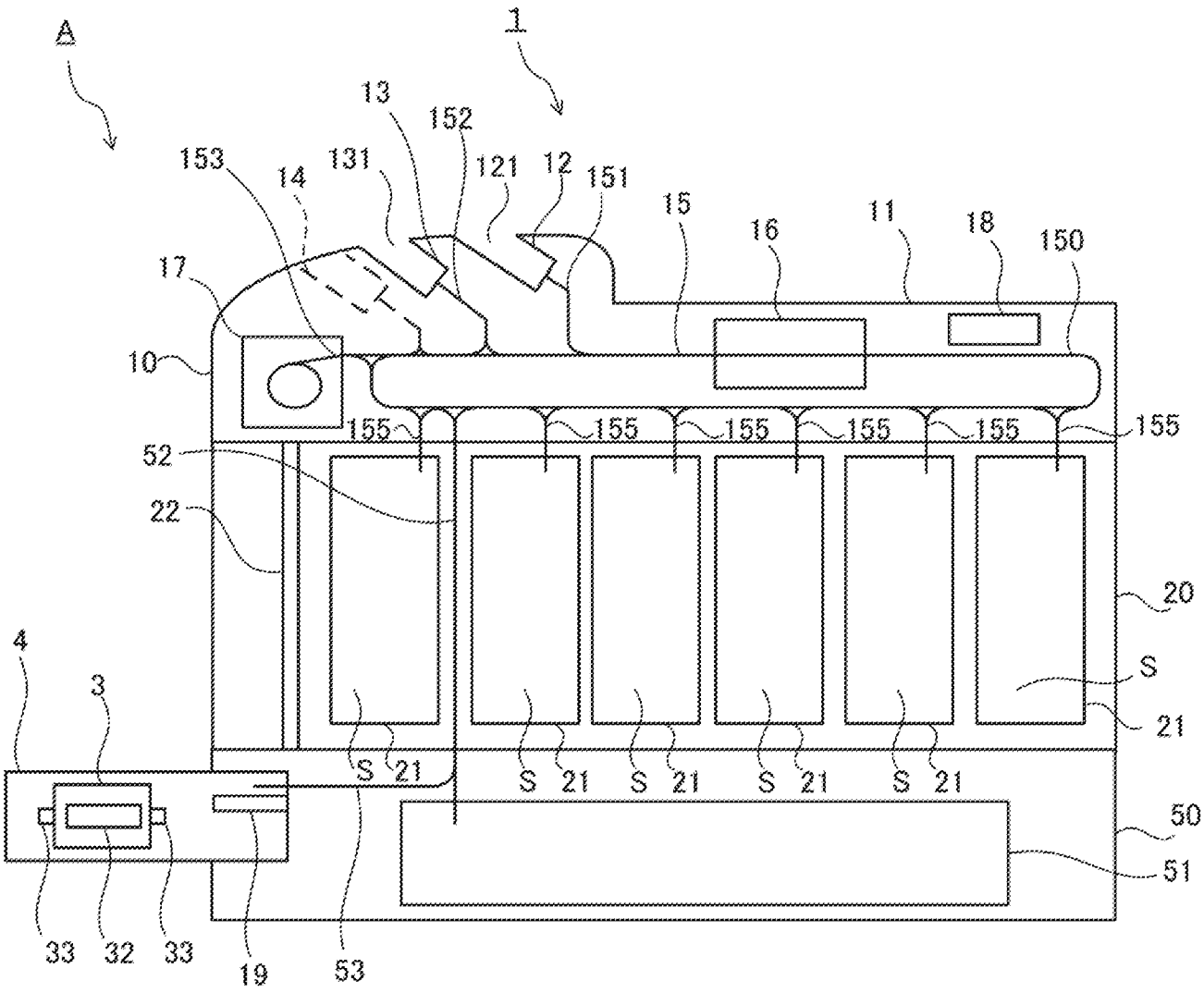
FIG. 7 is a schematic diagram showing a sheet processing system according to Embodiment 5 of the present invention.

A sheet processing system according to Embodiment 5 of the present invention is shown in FIG. 7. According to the present embodiment, the banknote processing apparatus 1 has a second storage 50 under the storage 20. A second storage unit 51 is placed in the second storage 50. The banknote processing apparatus 1 has a vertical transport path 52 that connects the looped transport path 150 and second storage unit 51 with each other by penetrating the storage 20. Also, a sixth branch path 53 is provided in the second storage 50 by branching off from the vertical transport path 52. The connector 19 is provided on a front side of the second storage 50.

The present embodiment allows the orientation changing section 4 to be attached to the banknote processing apparatus 1 even if there is no space to provide the fourth branch path 154 inside the processing section 10 or storage 20 or there is no space to mount the orientation changing section 4 around the processing section 10 or storage 20. Thus, even in such cases, banknotes can be transferred efficiently between the banknote processing apparatus 1 and banknote housing section 3 via the orientation changing section 4.

Note that although in the present embodiment, the connector 19 is provided on the front side of the second storage 50, the connector 19 may be provided on the back side of the second storage 50. In that case, the orientation changing section 4 and banknote housing section 3 can be mounted on a rear side of the banknote processing apparatus 1. This provides an advantage similar to that of Embodiment 3 when the banknote processing apparatus 1 is installed by being inserted halfway into the through-hole H (see FIG. 5) provided in the wall W.

Figure 8A:
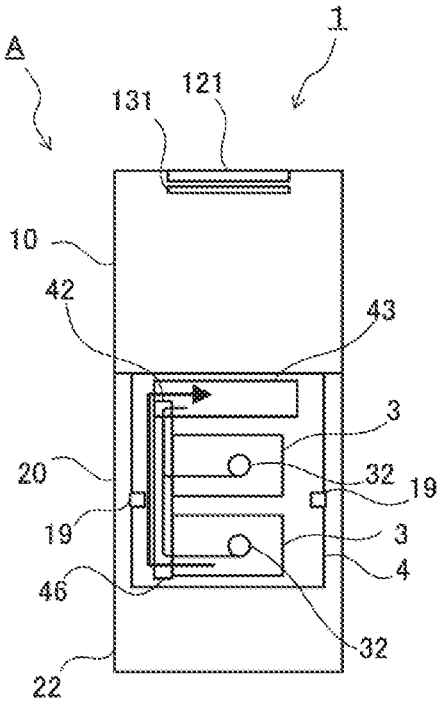
FIGS. 8A to 8C are schematic diagrams showing a sheet processing system according to Embodiment 6 of the present invention.
Figure 8B:
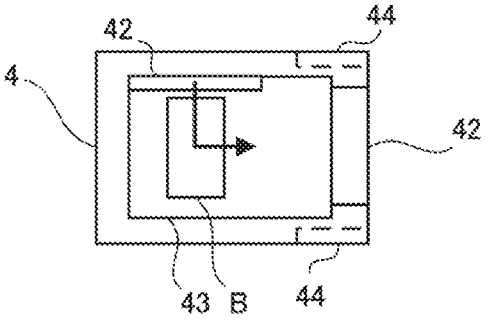
Figure 8C:
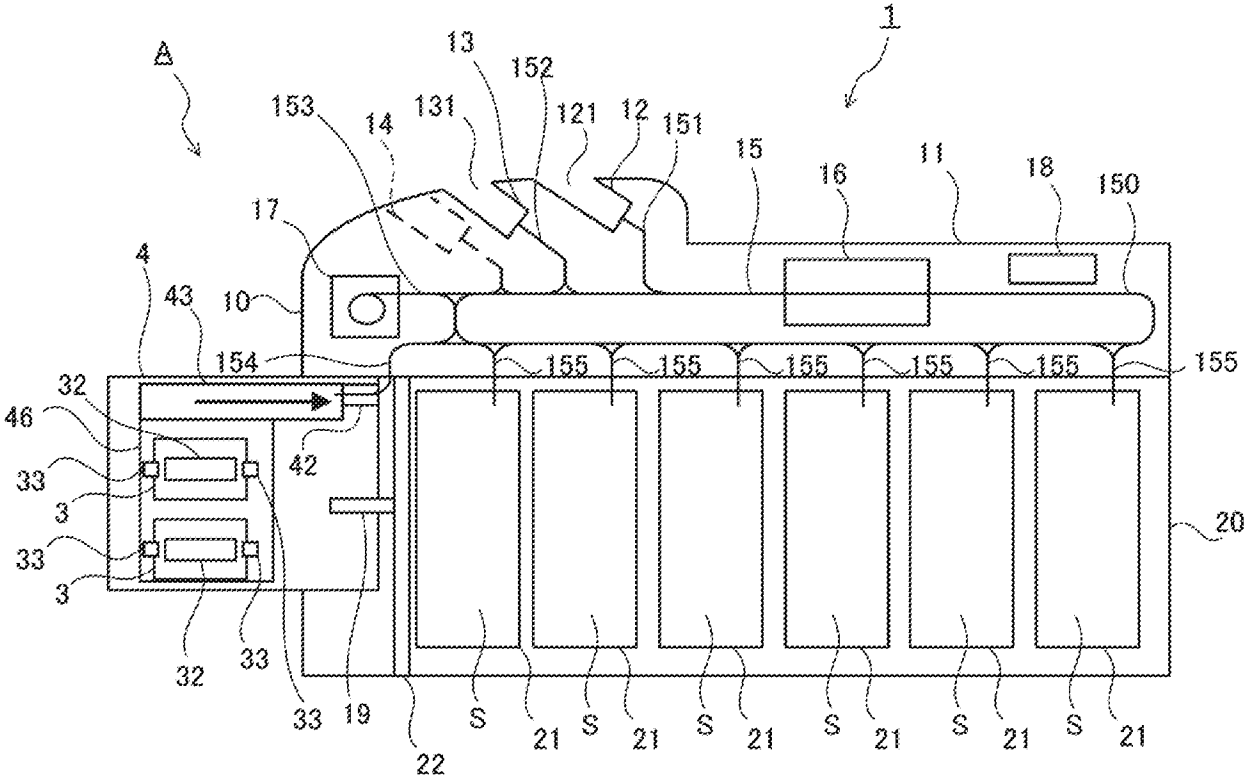

A sheet processing system according to Embodiment 6 of the present invention is shown in FIGS. 8A to 8C. FIG. 8A is a schematic front view of the banknote processing apparatus 1 to which the banknote housing section 3 is attached via the orientation changing section 4. FIG. 8B is a schematic plan view of the orientation changing section 4 shown in FIG. 8A. FIG. 8C is a schematic right side view of the banknote processing apparatus 1, banknote housing section 3, and orientation changing section 4 shown in FIG. 8A. Also, the arrows shown in FIGS. 8A to 8C indicate an example of banknote transport directions.

According to the present embodiment, the orientation changing section 4 has a delivery path 46 that allows two banknote housing sections 3 to be placed one above the other. The delivery path 46 is connected to each of the two banknote housing sections 3 and can deliver banknotes to/from each of the two banknote housing sections 3. An upper end of the delivery path 46 is connected to the orientation changing mechanism 43 via the first delivery section 42. The rest of the configuration of the orientation changing section 4 is similar to the configuration of the orientation changing section 4 shown in FIG. 1.

According to the present embodiment, banknotes B are supplied in long-edge leading orientation from a first of the banknote housing sections 3, and transported in long-edge leading orientation in a vertical direction on the delivery path 46. Upon reaching the first delivery section 42, the banknotes B are turned in transport direction from the vertical direction to a horizontal direction, and transported in long-edge leading orientation to the orientation changing mechanism 43. The banknotes B are caused to make a 90-degree turn in transport direction by the orientation changing mechanism 43 without rotating and supplied in short-edge leading orientation to the banknote processing apparatus 1 via the second delivery section 42.

According to the present embodiment, while banknotes B are being transferred between the first banknote housing section 3 and banknote processing apparatus 1, a second of the banknote housing sections 3 can be attached to the orientation changing section 4. Then, following the end of the operation of transferring the banknotes B between the first banknote housing section 3 and banknote processing apparatus 1, the operation of transferring the banknotes B can be continued between the second banknote housing section 3 and banknote processing apparatus 1. Meanwhile, the first banknote housing section 3 may be replaced with another banknote housing section 3. That is to say, the orientation changing section 4 sequentially performs delivery of the sheet between the sheet processing apparatus 1 and each of the plurality of the sheet housing sections 3. Thus, the operation of transferring the banknotes B between a large number of banknote housing sections 3 and banknote processing apparatus 1 can be performed continuously in a short time. Note that, of course, three or more banknote housing sections 3 may be attached to the orientation changing section 4. Also, during a replenishment process from the first banknote housing section 3 to the banknote processing apparatus 1, the rejected banknotes may be stored in the second banknote housing section 3. This eliminates the need to equip the banknote processing apparatus 1 with the temporary holding section 17 for use to store rejected banknotes.

Figure 9:
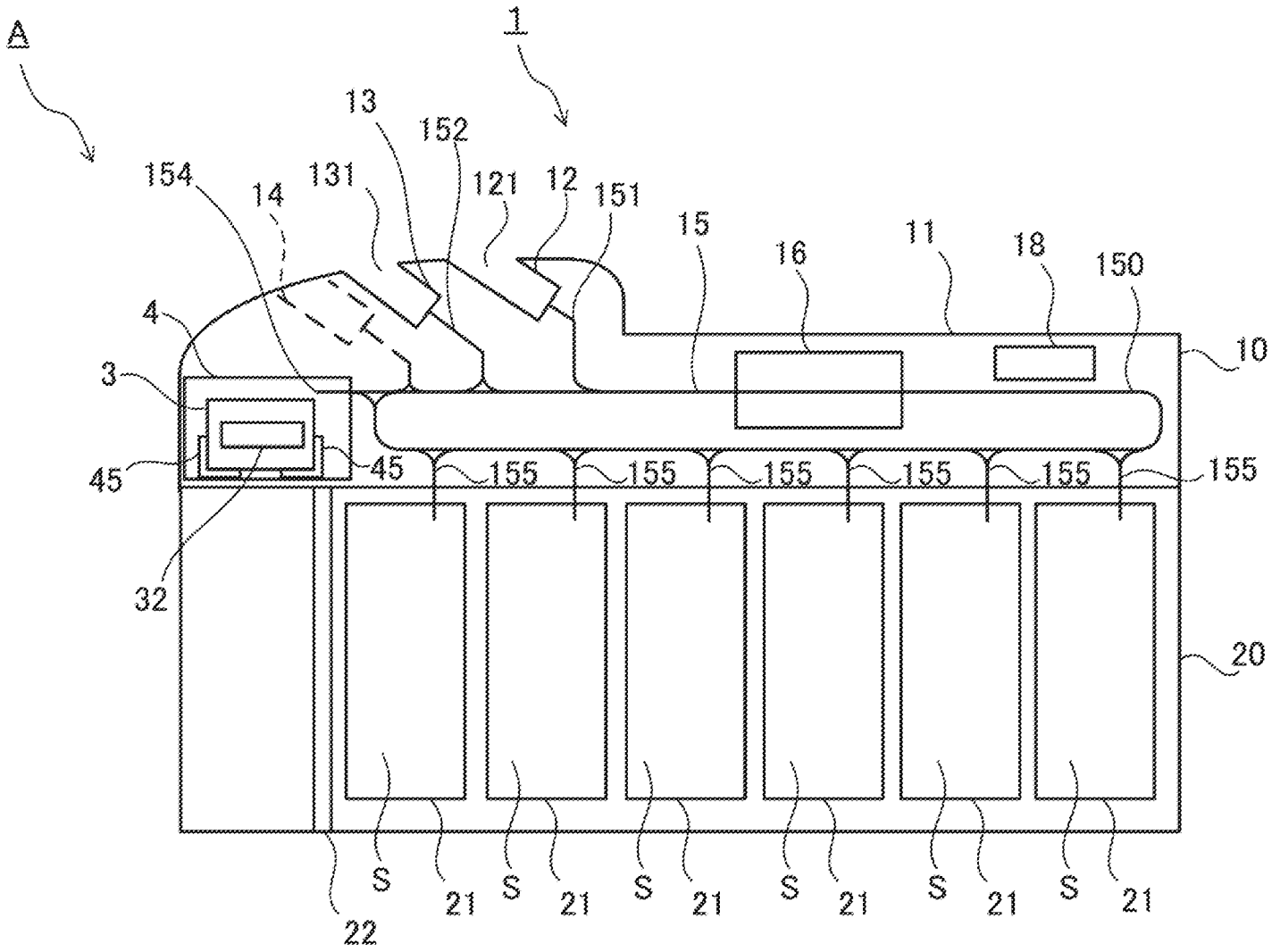
FIG. 9 is a schematic diagram showing a sheet processing system according to a seventh embodiment of the present invention.

A sheet processing system according to Embodiment 7 of the present invention is shown in FIG. 9. According to the present embodiment, the orientation changing section 4 is placed within the processing section 10. According to the present embodiment, the mount 45 for use to attach the banknote housing section 3 is provided on a right flank of the processing section 10. The banknotes transported in long-edge leading orientation from the banknote housing section 3 attached to the mount 45 are supplied to the orientation changing section 4, the transport orientation is changed to the short-edge leading orientation by the orientation changing section 4, and the banknotes are supplied in short-edge leading orientation to the looped transport path 150.

The present embodiment makes it possible to efficiently transfer banknotes between the banknote processing apparatus 1 that handles banknotes in short-edge leading orientation and banknote housing section 3 that handles banknotes in long-edge leading orientation, without carrying out the operation of attaching the orientation changing section 4 to the banknote processing apparatus 1.

Also, the present embodiment allows the banknotes deposited from the deposit section 12 to be housed in the storage units 21 or banknote housing section 3 by being sorted according to the kinds. For example, banknotes to which a polymer strip or a thread is attached in parallel to the short sides of the banknote as in the case of the new 20-euro note may be stored in a long edge direction and other banknotes may be stored in a short edge direction.

That is, according to the present embodiment, when the banknotes deposited through the deposit port 121 are identified by the identification section 16, by identifying whether the polymer or the like is attached to the banknotes, the destination can be switched according to identification results. The banknotes to which the polymer or the like is not attached can be stored in short-edge leading orientation in the storage units 21. Also, the banknotes to which the polymer or the like is attached, can be stored by being wound up in long-edge leading orientation by the banknote housing section 3 after the transport orientation is changed from the short-edge leading orientation to the long-edge leading orientation by the orientation changing section 4. In this way, a banknote processing system A according to the present embodiment can appropriately sort and store a mixture of various kinds of banknote.

Note that the orientation changing section 4 placed in the processing section 10 can also be configured in a manner similar to the orientation changing section 4 shown in FIGS. 8A to 8C. In that case, plural banknote housing sections 3 are attached to the banknote processing apparatus 1. Thus, as with Embodiment 6 shown in FIGS. 8A to 8C, the banknote transfer operation between the banknote processing apparatus 1 and banknote housing sections 3 can be performed continuously in a short time. Furthermore, of the banknotes deposited through the deposit port 121, the banknotes that are preferably be stored in long-edge leading orientation can be stored in long-edge leading orientation in the plural banknote housing sections 3 by being sorted according to the kinds.

Whereas embodiments of the present invention have been described above, the present invention is not limited to the above embodiments, and various changes can be made without departing from the spirit and scope of the present invention.

For example, the banknote housing section 3 is not limited to the take-up storage mechanism 32 in which plural sheets are stored by being wound around a rotating body in long-edge leading orientation, and may have a stacking storage in which plural sheets are stored in a stacked state. Also, the banknote housing section 3 may handle banknotes in short-edge leading orientation and the banknote processing apparatus 1 may handle banknotes in long-edge leading orientation.

Also, the orientation changing section 4 may be configured such that the two delivery sections 42 and the orientation changing mechanism 43 will be arranged in a straight line. In this case, the banknotes received in one of short-edge leading orientation and long-edge leading orientation are rotated themselves by 90 degrees by the orientation changing mechanism 43. The transport direction of the banknotes is not turned. Consequently, the banknotes are sent out of the orientation changing section 4 in the other of the transport orientations: short-edge leading orientation or long-edge leading orientation. Such an orientation changing mechanism is a publicly known technique as disclosed, for example, in Japanese Patent Application Laid-Open No. 2001-266215, and thus detailed description thereof will be omitted herein.

Also, the sheet processing apparatus is not limited to a banknote processing apparatus, and may be an apparatus that handles sheets including checks, vouchers, or other sheets made of paper or resin.

INDUSTRIAL APPLICABILITY

The present invention makes it possible to efficiently transfer sheets between a sheet processing apparatus that handles banknotes in short-edge leading orientation and a sheet processing apparatus that handles banknotes in long-edge leading orientation, via a sheet housing section detachably provided on either of the sheet processing apparatuses. The present invention therefore has greater industrial applicability.

REFERENCE SIGNS LIST

A Sheet processing system
1 Banknote processing apparatus
10 Processing section
11 Upper casing
12 Deposit section
121 Deposit port (opening)
13 Dispense section
131 Dispense port (opening)
14 Second dispense section
15 Transport section
150 Looped transport path
151 First branch path
152 Second branch path
153 Third branch path
154 Fourth branch path
155 Fifth branch path
16 Identification section
17 Temporary holding section
18 Control section
19 Connector
20 Storage
21 Storage unit

22 Storage door
23 Cover
3 Sheet housing section
31 Housing section casing
32 Storage mechanism
33 Mounting portion
4 Orientation changing section
41 Changing section casing
42 Delivery section
43 Orientation changing mechanism
44 Male connector
45 Mount
46 Delivery path
50 Second storage
51 Second storage unit
52 Vertical transport path
53 Sixth branch path
6 Second banknote processing apparatus
S Storage area
B Banknote
H Through-hole
W Wall

The invention claimed is:

1. A sheet processing system comprising:

a first sheet processing apparatus that transports and stores a sheet in one of short-edge leading orientation and long-edge leading orientation;

a second sheet processing apparatus that transports and stores a sheet in the other of short-edge leading orientation and long-edge leading orientation;

a sheet housing section that stores the sheet in the other of the short-edge leading orientation and the long-edge leading orientation and is used to transfer the sheet between the first sheet processing apparatus and the second sheet processing apparatus; and an orientation changing section that transports the sheet between the first sheet processing apparatus and the sheet housing section and changes transport orientation of the sheet which is being transported between the short-edge leading orientation and the long-edge leading orientation.

2. The sheet processing system according to claim 1, wherein the first sheet processing apparatus includes a connector for use to attach and detach the orientation changing section.

3. The sheet processing system according to claim 2, wherein the first sheet processing apparatus has the connector on a front side, a back side, or a top side of the first sheet processing apparatus.

4. The sheet processing system according to claim 3, wherein:

the first sheet processing apparatus includes:

a lockable storage that stores the sheet, and a processing section that is placed on top of the lockable storage and provided with a transport section and an opening section, the transport section being adapted to transport the sheet between the opening section and the lockable storage, and the first sheet processing apparatus has the connector on the front side of the first sheet processing apparatus below the processing section.

5. The sheet processing system according to claim 1, wherein the orientation changing section is placed inside the first sheet processing apparatus.

6. The sheet processing system according to claim 1, wherein a plurality of the sheet housing sections is provided; and the orientation changing section is connected with the plurality of the sheet housing sections and sequentially performs delivery of the sheet between the first sheet processing apparatus and each of the plurality of the sheet housing sections.

7. A sheet housing section used in a sheet processing system that includes:

a first sheet processing apparatus that transports and stores a sheet in one of short-edge leading orientation and long-edge leading orientation;

a second sheet processing apparatus that transports and stores the sheet in the other of short-edge leading orientation and long-edge leading orientation;

the sheet housing section that stores the sheet in the other of the short-edge leading orientation and the long-edge leading orientation and is used to transfer the sheet between the first sheet processing apparatus and the second sheet processing apparatus; and an orientation changing section that transports the sheet between the first sheet processing apparatus and the sheet housing section, and changes transport orientation of the sheet between the short-edge leading orientation and the long-edge leading orientation.

* * * * *